US010926975B2

(12) United States Patent
Guilani et al.

(10) Patent No.: US 10,926,975 B2
(45) Date of Patent: Feb. 23, 2021

(54) GROOVED BELT FOR ELEVATOR SYSTEM

(71) Applicant: Otis Elevator Company, Farmington, CT (US)

(72) Inventors: Brad Guilani, Woodstock Valley, CT (US); Kathryn Rauss Sherrick, Bristol, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 305 days.

(21) Appl. No.: 15/301,442

(22) PCT Filed: Apr. 1, 2014

(86) PCT No.: PCT/US2014/032524

§ 371 (c)(1),
(2) Date: Oct. 3, 2016

(87) PCT Pub. No.: WO2015/152899

PCT Pub. Date: Oct. 8, 2015

(65) Prior Publication Data

US 2017/0022029 A1 Jan. 26, 2017

(51) Int. Cl.

| | |
|---|---|
| ***B66B 7/06*** | (2006.01) |
| ***D07B 1/22*** | (2006.01) |
| ***D07B 5/00*** | (2006.01) |
| ***B66B 9/00*** | (2006.01) |

(52) U.S. Cl.

CPC ..... *B66B 7/062* (2013.01); *B66B 9/00* (2013.01); *D07B 1/22* (2013.01); *D07B 5/006* (2015.07); *D07B 2201/2086* (2013.01); *D07B 2201/2087* (2013.01); *D07B 2501/2007* (2013.01)

(58) Field of Classification Search

CPC ..... B66B 7/062; D07B 2501/2007; D07B 2201/2086

See application file for complete search history.

(56) References Cited

U.S. PATENT DOCUMENTS

| | | | | |
|---|---|---|---|---|
| 5,704,862 | A | 1/1998 | Janne et al. | |
| 6,056,656 | A | 5/2000 | Kitano et al. | |
| 9,828,215 | B2 * | 11/2017 | Pelto-Huikko | B66B 7/062 |
| 2008/0087500 | A1 | 4/2008 | Ach et al. | |

(Continued)

FOREIGN PATENT DOCUMENTS

| | | | |
|---|---|---|---|
| CN | 1244906 | A | 2/2000 |
| CN | 1902119 | A | 1/2007 |

(Continued)

OTHER PUBLICATIONS

English Machine Translation of WO 2004/043843 May 2004.*

(Continued)

*Primary Examiner* — Diem M Tran

(74) *Attorney, Agent, or Firm* — Cantor Colburn LLP

(57) ABSTRACT

A belt for suspending and/or driving an elevator car of an elevator system includes a plurality of tension members spaced from each other along a width of the belt and extending longitudinally along a length of the belt. A jacket at least partially envelopes the plurality of tension members and forms at least one outer belt surface along a width of the belt. A groove is located in the at least one outer belt surface extending longitudinally along the length of the belt.

13 Claims, 5 Drawing Sheets

(56) References Cited

U.S. PATENT DOCUMENTS

| | | | | |
|---|---|---|---|---|
| 2009/0166132 | A1 | 7/2009 | Ach | |
| 2010/0243378 | A1 | 9/2010 | Begle | |
| 2011/0226563 | A1 | 9/2011 | Goser | |
| 2011/0240408 | A1 | 10/2011 | Wesson et al. | |
| 2015/0291394 | A1* | 10/2015 | Dold | B66B 7/062 324/693 |

FOREIGN PATENT DOCUMENTS

| | | | | |
|---|---|---|---|---|
| CN | 101044084 | A | 9/2007 | |
| CN | 101827772 | A | 9/2010 | |
| CN | 102209678 | A | 10/2011 | |
| CN | 102216191 | A | 10/2011 | |
| DE | 102009003796 | A1 | 10/2010 | |
| DE | 102009025954 | A1 | 12/2010 | |
| WO | WO-2004043843 | A1 * | 5/2004 | B66B 7/062 |

OTHER PUBLICATIONS

Chinese Office Action Issued in CN Application No. 201480077809.2, dated Apr. 8, 2018, 7 Pages.

European Search Report Issued in EP Application No. 14888104.8, dated Oct. 2, 2017, 9 Pages.

Notification of Transmittal of the International Search Report and the Written Opinion of the International Searching Authority, or the Declaration; Application No. PCT/US2014/032524; dated Dec. 26, 2014; 13 pages.

* cited by examiner

GROOVED BELT FOR ELEVATOR SYSTEM

CROSS REFERENCE TO RELATED APPLICATIONS

This application claims priority to PCT Patent Application No. PCT/US2014/032524 filed Apr. 1, 2014, the entire contents of which is incorporated herein by reference.

BACKGROUND

The subject matter disclosed herein relates to elevator systems. More specifically, the subject disclosure relates to configurations of coated steel belts for suspending and/or driving elevator cars of an elevator system.

Elevator systems utilize ropes or belts operably connected to an elevator car, and routed over one or more sheaves, also known as pulleys, to propel the elevator car along a hoistway. Coated steel belts in particular include a plurality of wires located at least partially within a jacket material. The plurality of wires is often arranged into one or more strands and the strands are then arranged into one or more cords. In an exemplary belt construction, a plurality of cords is typically arranged equally spaced within a jacket in a longitudinal direction. The jacket is typically a polymeric-based material such as rubber or polyurethane.

The belt interacts with the sheaves in the elevator system, one or more of which is a traction sheave driven by a machine. The system utilizes traction between the belt and the traction sheave, such that when the traction sheave is rotated by the machine, the belt is driven over the traction sheave to raise or lower the elevator car along its path. A critical characteristic of the traction sheave/belt interface is stable and predictable traction of a desired level between the belt and the surface of the traction sheave. Further, the belt should be flexible in order to travel uniformly over crowned sheaves of the elevator system used to enhance tracking of the elevator belt.

BRIEF DESCRIPTION

In one embodiment, a belt for suspending and/or driving an elevator car of an elevator system includes a plurality of tension members spaced from each other along a width of the belt and extending longitudinally along a length of the belt. A jacket at least partially envelopes the plurality of tension members and forms at least one outer belt surface along a width of the belt. A groove is located in the at least one outer belt surface extending longitudinally along the length of the belt.

Additionally or alternatively in this or other embodiments, the groove is positioned laterally between adjacent tension members of the plurality of tension members.

Additionally or alternatively in this or other embodiments, the groove has a groove depth between one tenth and one half of a jacket material depth at the tension member.

Additionally or alternatively in this or other embodiments, the groove has a ratio of groove width to groove depth of 1 or more.

Additionally or alternatively in this or other embodiments, the groove is discontinuous along a length of the belt.

Additionally or alternatively in this or other embodiments, two or more grooves are arranged in nonidentical lateral positions in the belt outer surface.

Additionally or alternatively in this or other embodiments, the two or more grooves are staggered in position longitudinally along the belt length.

Additionally or alternatively in this or other embodiments, two belt outer surfaces define a belt thickness, each outer belt surface including a groove.

Additionally or alternatively in this or other embodiments, the plurality of tension members include a plurality of wires arranged into a plurality of cords.

Additionally or alternatively in this or other embodiments, the jacket material is one of a rubber or polyurethane material.

In another embodiment, an elevator system includes an elevator car, one or more sheaves and one or more belts operably connected to the car and interactive with the one or more sheaves for suspending and/or driving the elevator car. Each belt of the one or more belts includes a plurality of tension members spaced from each other along a width of the belt and extending longitudinally along a length of the belt. A jacket at least partially envelopes the plurality of tension members and forms at least one outer belt surface along a width of the belt. The outer belt surface is interactive with the one or more sheaves. A groove is located in the at least one outer belt surface extending longitudinally along the length of the belt.

Additionally or alternatively in this or other embodiments, the groove is positioned laterally between adjacent tension members of the plurality of tension members.

Additionally or alternatively in this or other embodiments, the groove has a groove depth between one tenth and one half of a jacket material depth at the tension member.

Additionally or alternatively in this or other embodiments, the groove has a ratio of groove width to groove depth of 1 or more.

Additionally or alternatively in this or other embodiments, the groove is discontinuous along a length of the belt.

Additionally or alternatively in this or other embodiments, two or more grooves are arranged in nonidentical lateral positions in the belt outer surface.

Additionally or alternatively in this or other embodiments, the two or more grooves are staggered in position longitudinally along the belt length.

Additionally or alternatively in this or other embodiments, two belt outer surfaces define a belt thickness, each outer belt surface including a groove.

Additionally or alternatively in this or other embodiments, a sheave of the one or more sheaves includes a crowned sheave surface and the groove increases belt conformance to the crowned sheave surface.

Additionally or alternatively in this or other embodiments, the jacket material is one of a rubber or polyurethane material.

The detailed description explains the invention, together with advantages and features, by way of examples with reference to the drawings.

DETAILED DESCRIPTION

Figure 1A:
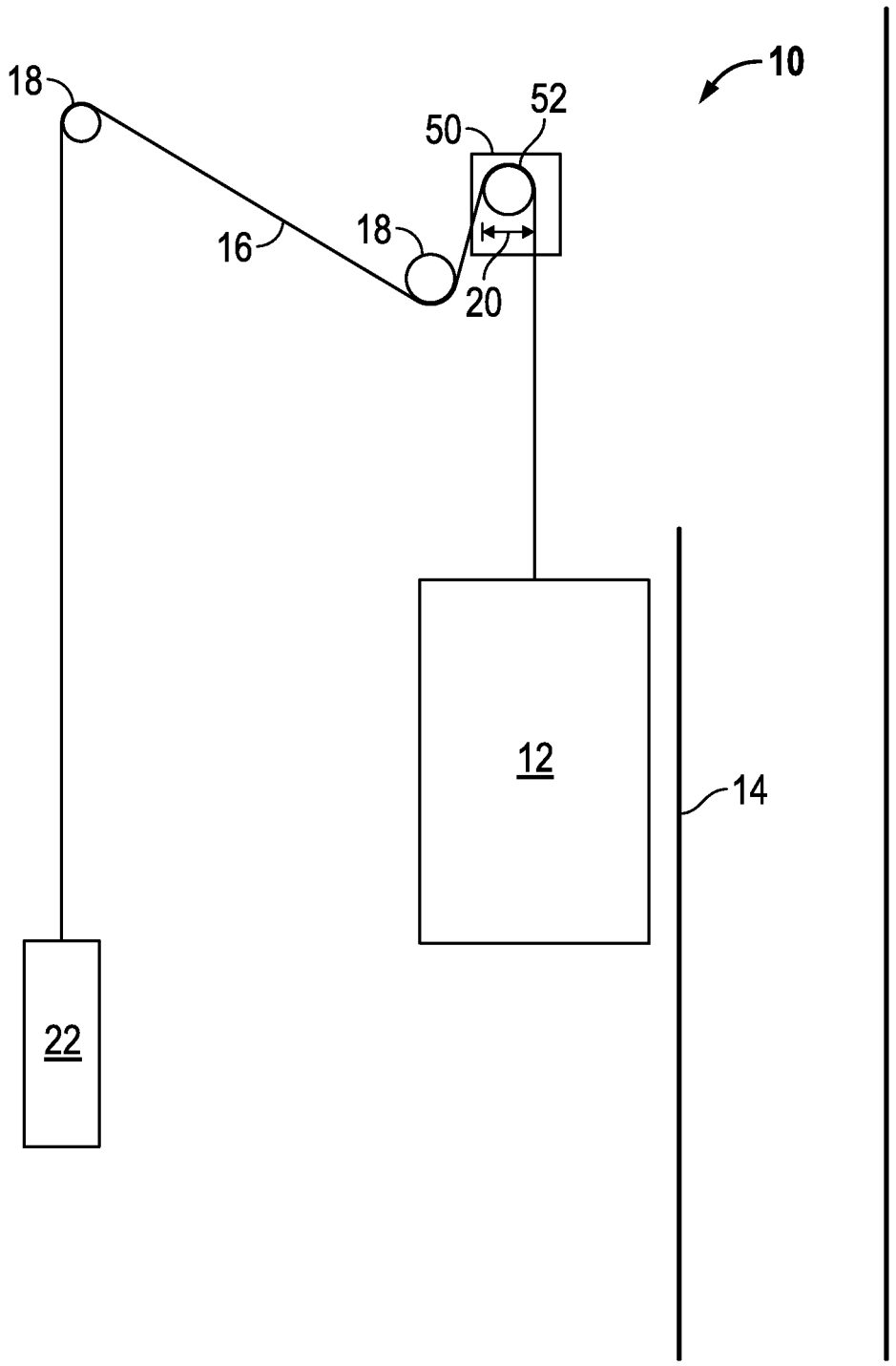
FIG. 1A is a schematic of an exemplary elevator system having a 1:1 roping arrangement.
Figure 1B:
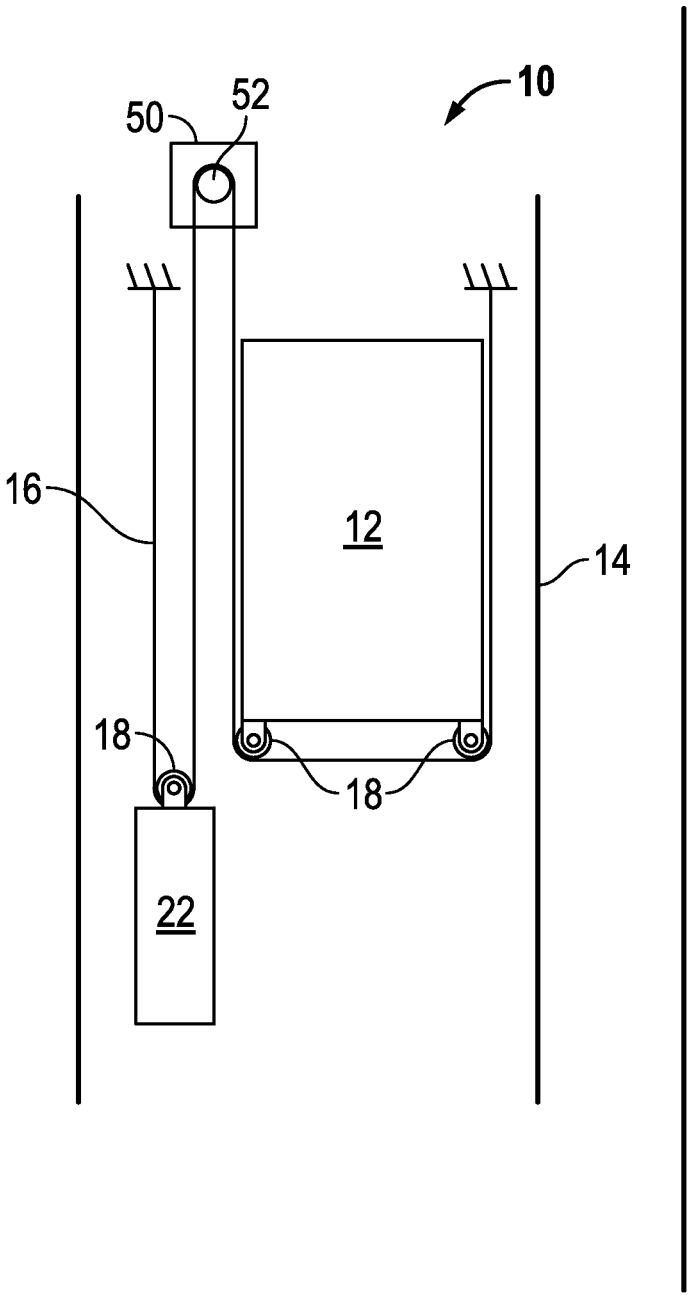
FIG. 1B is a schematic of another exemplary elevator system having a different roping arrangement.
Figure 1C:
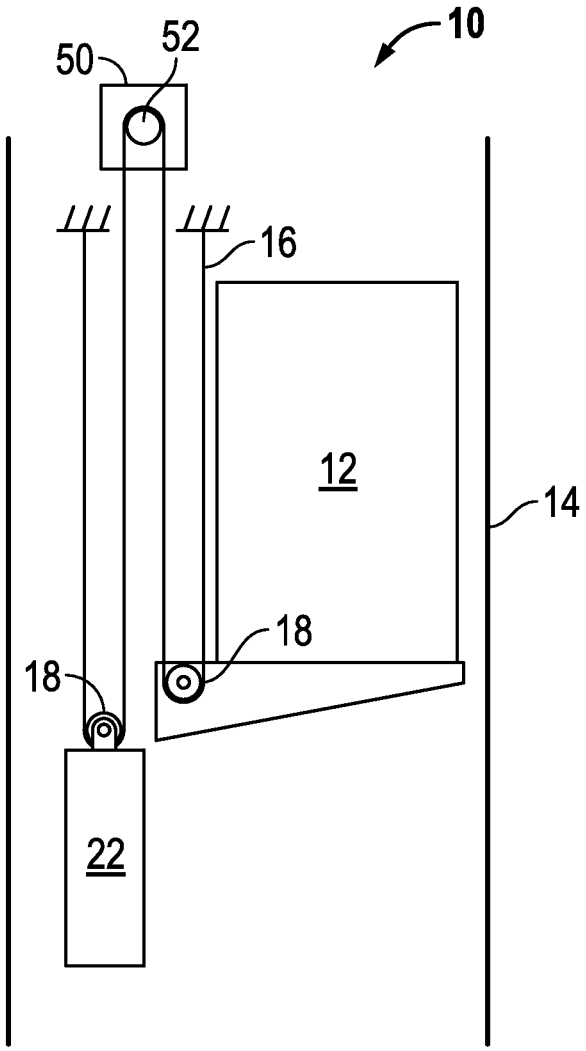
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves 18 could be a drive sheave. A drive sheave is driven by a machine 50. Movement of drive sheave by the machine 50 drives, moves and/or propels (through traction) the one or more belts 16 that are routed around the drive sheave.

At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machine room-less elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present invention could be used on elevator systems other than the exemplary types shown in FIGS. 1A, 1B and 1C.

Figure 2:
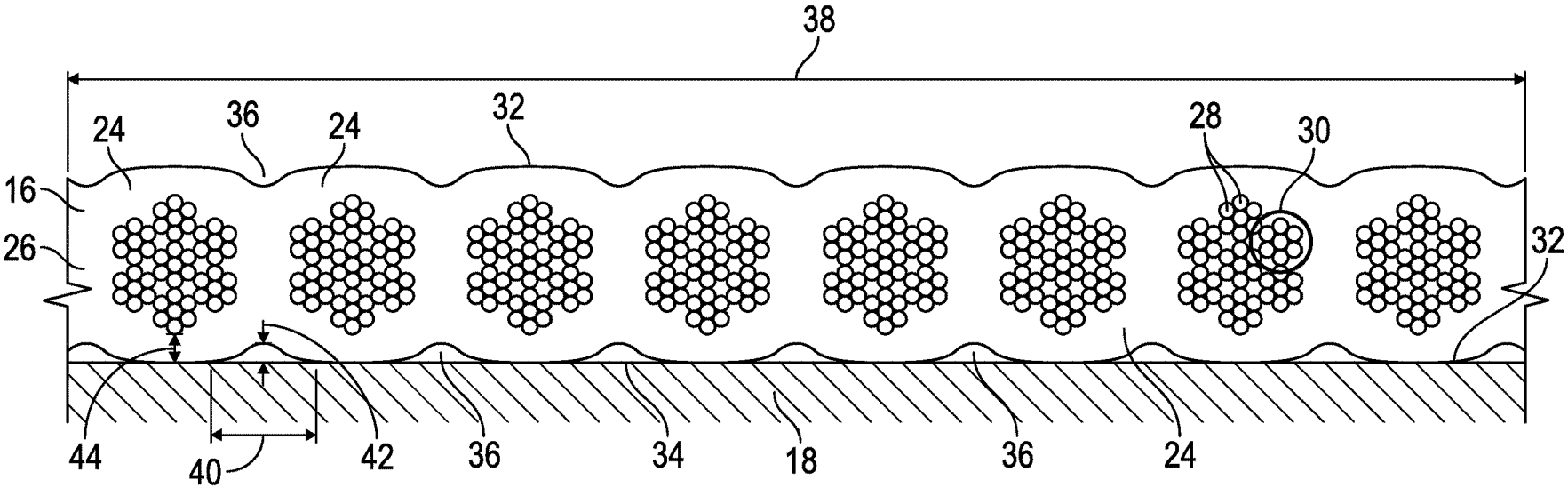
FIG. 2 is a cross-sectional view of an embodiment of a belt for an elevator system.

FIG. 2 provides a schematic of an exemplary belt construction or design. Each belt 16 is constructed of a plurality of tension members, for example, cords 24 in a jacket 26. The cords 24 of the belt 16 could all be identical, or some or all of the cords 24 used in the belt 16 could be different than the other cords 24. The cords 24 are the primary load-carrying members of the belt 16. For example, one or more of the cords 24 could have a different construction or size than the other cords 24. The cords 24 may be formed from a plurality of wires 28, which in some embodiments are arranged into a plurality of strands 30. As seen in FIG. 2, the belt 16 has an aspect ratio greater than one (i.e. belt width is greater than belt thickness).

The belt 16 is constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

The jacket 26 could be any suitable material, including a single material, multiple materials, two or more layers using the same or dissimilar materials, and/or a film. In one arrangement, the jacket 26 could be a polymer, such as an elastomer, applied to the cords 24 using, for example, an extrusion or a mold wheel process. In another arrangement, the jacket 26 could be a textile that engages and/or integrates the cords 24. As an additional arrangement, the jacket 26 could be one or more of the previously mentioned alternatives in combination.

The jacket 26 can substantially retain the cords 24 therein. The phrase substantially retain means that the jacket 26 has sufficient engagement with the cords 24 such that the cords 24 do not pull out of, detach from, and/or cut through the jacket 26 during the application on the belt 16 of a load that can be encountered during use in an elevator system 10 with, potentially, an additional factor of safety. In other words, the cords 24 remain at their original positions relative to the jacket 26 during use in an elevator system 10. The jacket 26 could completely envelop the cords 24 (such as shown in FIG. 2), substantially envelop the cords 24, or at least partially envelop the cords 24

The belt 16 includes at least one traction surface 32 interactive with a sheave outer surface 34. The sheave outer surface 34 may be substantially flat along its width as shown, or alternatively may include a crown or other features to improve tracking of the belt 16 over the sheave 18. Some belts 16 may have two traction surfaces 32, for use in elevator systems where the sheave 18 dictates that two traction surfaces 32 will interact with sheaves 18, such as the arrangement shown in FIG. 1A.

Figure 4:
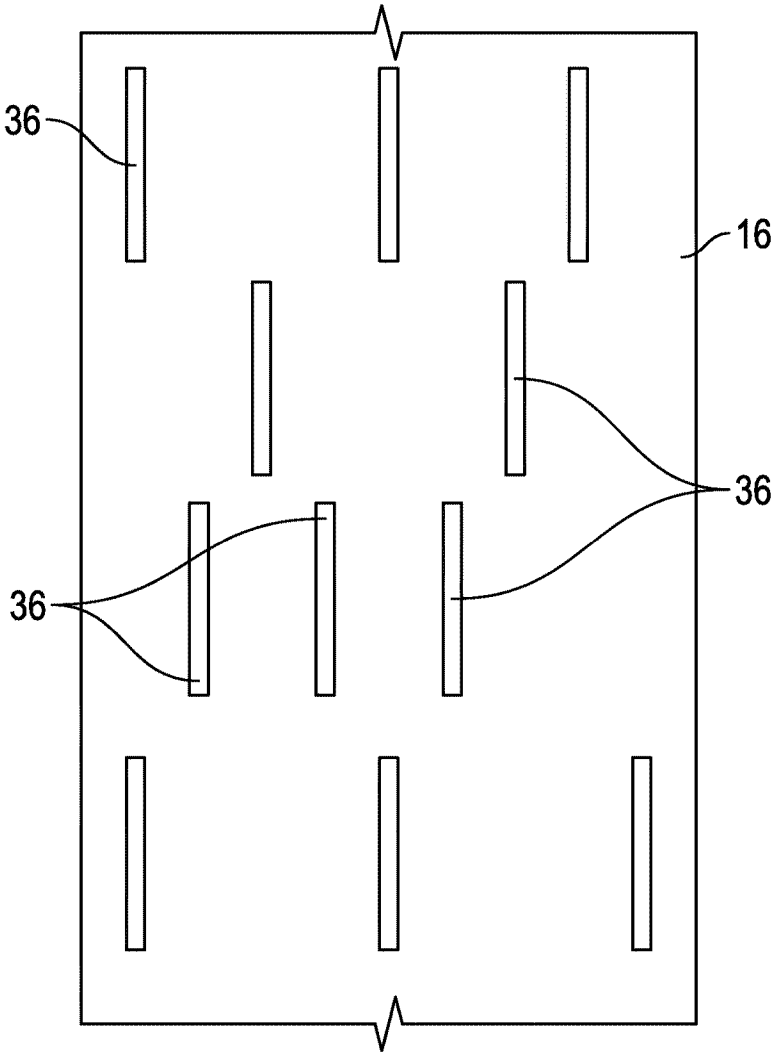
FIG. 4 is a plan view of another embodiment of a belt for an elevator system.
Figure 3:
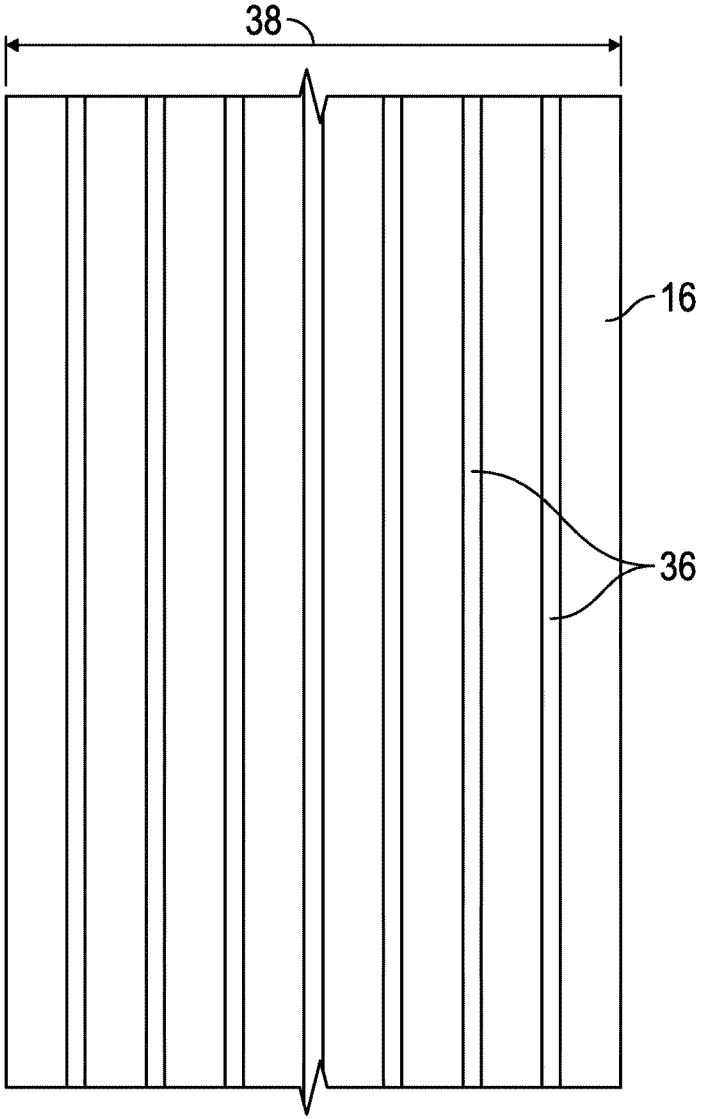
FIG. 3 is a plan view of an embodiment of a belt for an elevator system.

The belt 16 includes a plurality of grooves 36 formed in the jacket 26, extending longitudinally along a length of the belt 16 as shown in FIG. 3. Referring again to the cross-section of FIG. 2, the grooves 36 are arrayed along a belt width 38 with, in some embodiments, each groove 36 positioned between adjacent cords 24 of the belt 16. Each groove 36 has a groove width 40 and a groove depth 42, and in some embodiments a ratio of groove width 40 to groove depth 42 is greater than 1. In some embodiments, the groove depth 42 is related to a jacket material depth 44 at each cord 24, at which the jacket material depth is thinnest, and may be between one-tenth and one-half of the jacket material depth 44. The grooves 36 may have a smooth, continuous curvilinear shape along their width as shown in FIG. 2, but other groove 36 shapes, such as U-shaped or V-shaped may also be utilized. Further, the grooves 36 may have substantially identical cross-sections as shown or may be varied depending on their location in the belt 16. In some embodiments, as shown in FIG. 3, the grooves 36 are continuous along a length of the belt 16, while in other embodiments, such as shown in FIG. 4, the grooves 36 may be discontinuous or staggered along the length of the belt 16. Further, the grooves 36 may have varying cross-sectional shapes along their length.

The grooves 36 may be formed in the belt 16 during the mold wheel or extrusion process of jacket 26 application to the cords 24, or alternatively may be formed via a secondary process. For example, the belt 16 may be passed through a secondary molding process to form the grooves 36 in the jacket 26 while the jacket 26 is still at an elevated temperature from the initial application process. Alternatively, after forming of the jacket 26 on the belt 16 in completed, the grooves 36 may be formed in the jacket 26 by, for example, a machining process.

The grooved traction surface 32 interacts with the continuous sheave outer surface 34 to stabilize traction due to the reduction in surface area of the traction surface 32 in contact with the sheave outer surface 34, compared to a continuous, grooveless traction surface. The introduction of grooves 36 also improves flexibility of the belt 16, increasing conformability of the belt 16 to the sheave outer surface 34, especially when the sheave outer surface 34 includes a crown. This property is useful, too when it is required to utilize a comparatively stiff jacket 26 material to satisfy other performance requirements such as durability or service life. Yet another advantage provided by inclusion of the grooves 36 in the belt 16 is that the grooves 36 increase resistance of the belt 16 to decreases in performance due to external contaminants, such as dry contaminants. During operation of the elevator system, such materials are shunted to and collected in the grooves 36 away from the contact portions of the traction surface 32 to the sheave outer surface 34.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A belt for suspending or driving an elevator car of an elevator system comprising:

a plurality of tension members spaced from each other along a width of the belt and extending longitudinally along a length of the belt;

a jacket at least partially enveloping the plurality of tension members and forming at least one outer belt surface along the width of the belt;

a groove located in the at least one outer belt surface extending longitudinally along the length of the belt;

wherein the groove has a groove depth between one tenth and one half of a jacket material depth at the tension member, the jacket material depth measured from an outer belt surface to the plurality of tension members at the same outer belt surface at which the groove is disposed;

wherein the groove is disposed laterally between adjacent tension members of the plurality of tension members;

wherein the the groove has a smooth, continuous curvilinear shape along its width; and wherein the groove is discontinuous along the length of the belt.

2. The belt of claim 1, wherein the groove has a ratio of groove width to groove depth of 1 or more.

3. The belt of claim 1, further comprising two or more grooves arranged in nonidentical lateral positions in the belt outer surface.

4. The belt of claim 3, wherein the two or more grooves are staggered in position longitudinally along the belt length.

5. The belt of claim 1, further comprising two belt outer surfaces defining a belt thickness, each outer belt surface including a groove.

6. The belt of claim 1, wherein the plurality of tension members comprise a plurality of wires arranged into a plurality of cords.

7. The belt of claim 1, wherein the jacket material is one of a rubber or polyurethane material.

8. An elevator system comprising:

an elevator car;

one or more sheaves; and one or more belts operably connected to the car and interactive with the one or more sheaves for suspending or driving the elevator car, each belt of the one or more belts including:

a plurality of tension members spaced from each other along a width of the belt and extending longitudinally along a length of the belt;

a jacket at least partially enveloping the plurality of tension members and forming at least one outer belt surface along the width of the belt, the outer belt surface interactive with the one or more sheaves;

a groove located in the at least one outer belt surface extending longitudinally along the length of the belt;

wherein the groove has a groove depth between one tenth and one half of a jacket material depth at the tension member, the jacket material depth measured from an outer belt surface to the plurality of tension members at the same outer belt surface at which the groove is disposed;

wherein the groove is disposed laterally between adjacent tension members of the plurality of tension members;

wherein the the groove has a smooth, continuous curvilinear shape along its width: and wherein the groove is discontinuous along the length of the belt.

9. The elevator system of claim 8, wherein the groove has a ratio of groove width to groove depth of 1 or more.

10. The elevator system of claim 8, further comprising two or more grooves arranged in nonidentical lateral positions in the belt outer surface.

11. The elevator system of claim 10, wherein the two or more grooves are staggered in position longitudinally along the belt length.

12. The elevator system of claim 8, further comprising two belt outer surfaces defining a belt thickness, each outer belt surface including a groove.

13. The elevator system of claim 8, wherein the jacket material is one of a rubber or polyurethane material.

* * * * *